US007282001B2

(12) United States Patent
Ponzini

(10) Patent No.: US 7,282,001 B2
(45) Date of Patent: Oct. 16, 2007

(54) PRESSURE GRIP FOR GOALIE HOCKEY STICK

(76) Inventor: Richard J. Ponzini, 1308 Scarborough Dr., Brewster, NY (US) 10509

( * ) Notice: Subject to any disclaimer, the term of this patent is extended or adjusted under 35 U.S.C. 154(b) by 0 days.

(21) Appl. No.: 11/089,273

(22) Filed: Mar. 24, 2005

(65) Prior Publication Data

US 2006/0217218 A1 Sep. 28, 2006

(51) Int. Cl.
*A63B 59/14* (2006.01)

(52) U.S. Cl. ..... 473/560

(58) Field of Classification Search ..... 473/560–563
See application file for complete search history.

(56) References Cited

U.S. PATENT DOCUMENTS 3,940,134 A 2/1976 Bieganowski ..... 273/67
4,052,059 A * 10/1977 Rigsby ..... 473/560
4,553,753 A * 11/1985 Gibbons ..... 473/560
5,263,711 A * 11/1993 Addis et al. ..... 473/562
5,456,463 A * 10/1995 Dolan et al. ..... 473/563
6,248,031 B1 * 6/2001 Brodie ..... 473/560
2002/0094891 A1 * 7/2002 Horwood et al. ..... 473/560

FOREIGN PATENT DOCUMENTS

CA 2198272 * 8/1998

* cited by examiner

*Primary Examiner*—Mark S. Graham
(74) *Attorney, Agent, or Firm*—Donald J. Ersler

(57) ABSTRACT

A pressure grip for a goalie hockey stick includes a support boot and a hand grip. The support boot includes a paddle portion and a handle portion. An inside perimeter of the paddle portion is sized to receive a paddle of the hockey stick and an inside perimeter of the handle portion is sized to receive a handle of the hockey stick. A thumb grip preferably extends from the handle portion. A grip slot is formed through the handle portion to receive the hand grip. The hand grip preferably includes a pivotal handle, a projection plate and at least one spring. The pivotal handle and the projection plate are pivotally retained by the support boot. The at least one spring is preferably retained in the pivotal handle. The projection plate includes a plurality of projections. The plurality of projections dig into the handle of the hockey stick.

14 Claims, 2 Drawing Sheets

PRESSURE GRIP FOR GOALIE HOCKEY STICK

BACKGROUND OF THE INVENTION

1. Field of the Invention

The present invention relates generally to hockey and more specifically to a pressure grip for a goalie hockey stick, which provides superior control, because a hand grip digs into the hockey stick handle.

2. Discussion of the Prior Art

U.S. Pat. No. 3,940,134 to Bieganowski discloses a hockey stick handle device. The Bieganowski patent includes an elongated, rigid, torque-increasing sleeve telescopically received on the flexible handle of a hockey stick; the sleeve being freely slidable. However, the Bieganowski patent does not teach or suggest a sleeve that digs into the handle of a hockey stick.

Accordingly, there is a clearly felt need in the art for a pressure grip for a goalie hockey stick, which provides superior control, because a hand grip includes projections that dig into the hockey stick handle and the pressure grip also improves hand strength.

SUMMARY OF THE INVENTION

The present invention provides a pressure grip for a goalie hockey stick, which improves hand strength. The pressure grip for a goalie hockey stick (pressure grip) includes a support boot and a hand grip. The support boot includes a paddle portion and a handle portion. The handle portion extends from the paddle portion. An inside perimeter of the paddle portion is sized to receive an outer perimeter of a paddle of the goalie hockey stick. An inside perimeter of the handle portion is sized to receive an outer perimeter of a handle of the goalie hockey stick. A thumb grip preferably extends from the handle portion.

A grip slot is formed through the handle portion opposite the thumb grip. The grip slot is sized to receive the hand grip. The hand grip preferably includes a pivotal handle, a projection plate and at least one spring. One end of the pivotal handle and one end of the projection plate are pivotally secured to the support boot. The at least one spring is preferably retained in the pivotal handle. The projection plate includes a plurality of projections. The plurality of projections dig into the handle of a hockey stick, when hand pressure is applied against the pivotal handle. The at least one spring is preferably strong enough to improve hand strength by squeezing the pivotal handle.

Accordingly, it is an object of the present invention to provide a pressure grip, which includes a plurality of projections that dig into the hockey stick handle, when hand pressure is applied.

Finally, it is another object of the present invention to provide a pressure grip, which improves the hand strength of the player.

These and additional objects, advantages, features and benefits of the present invention will become apparent from the following specification.

DETAILED DESCRIPTION OF THE PREFERRED EMBODIMENTS

Figure 1:
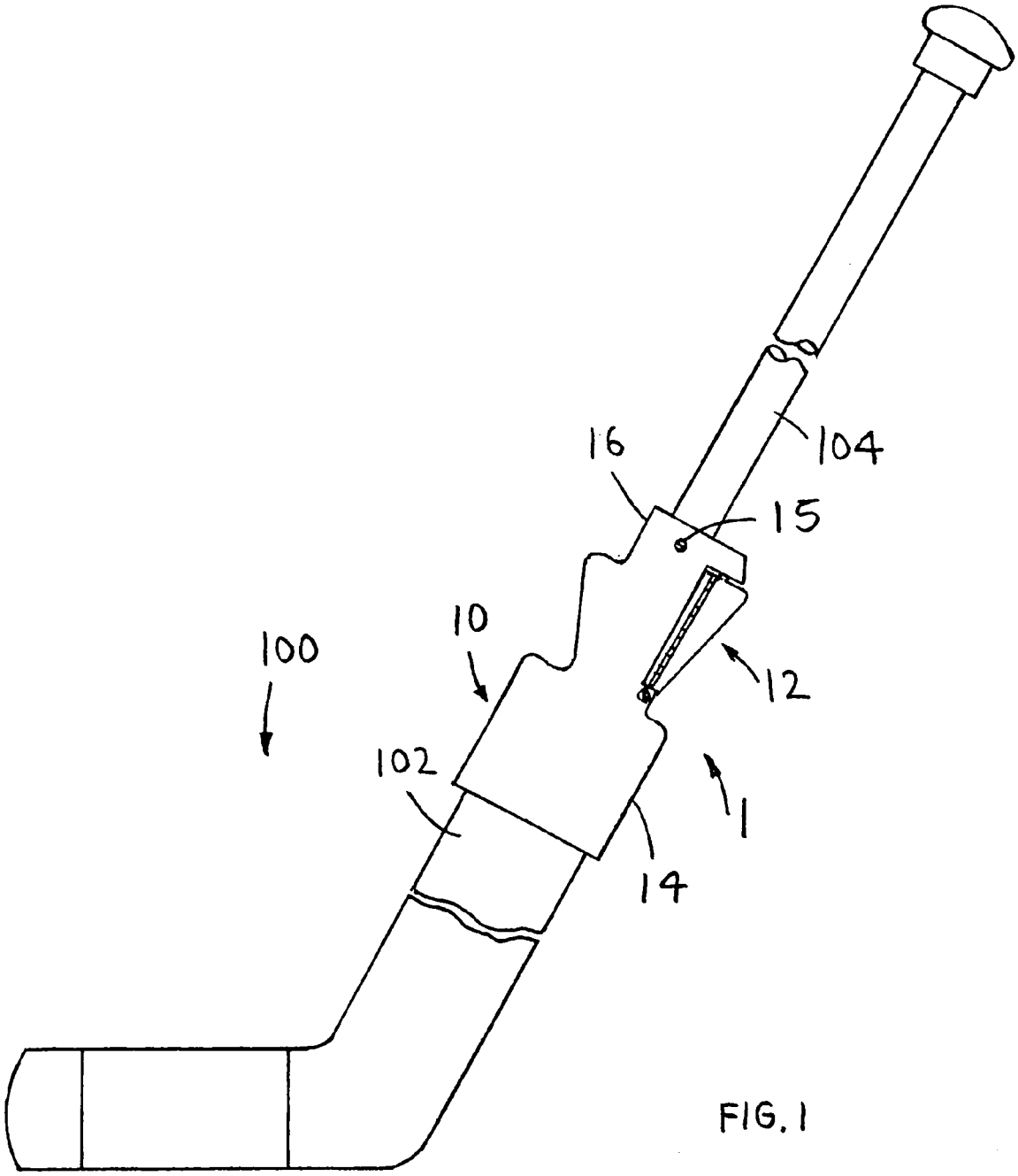
FIG. 1 is a side view of a pressure grip attached to a goalie hockey stick in accordance with the present invention.
Figure 3:
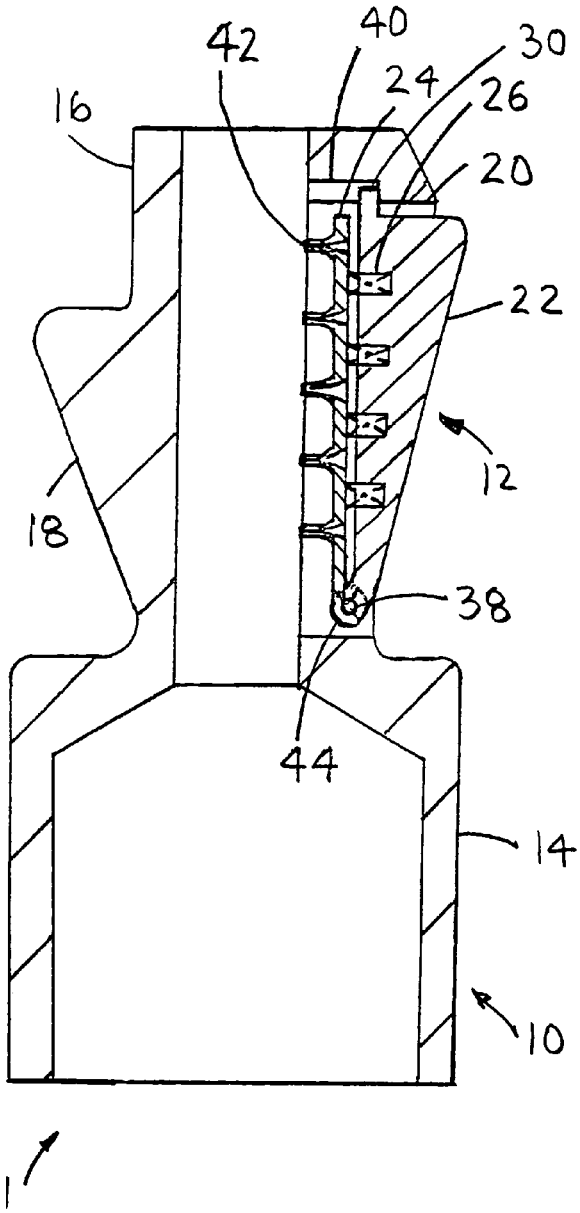
FIG. 3 is an end view of a pressure grip in accordance with the present invention.
Figure 2:
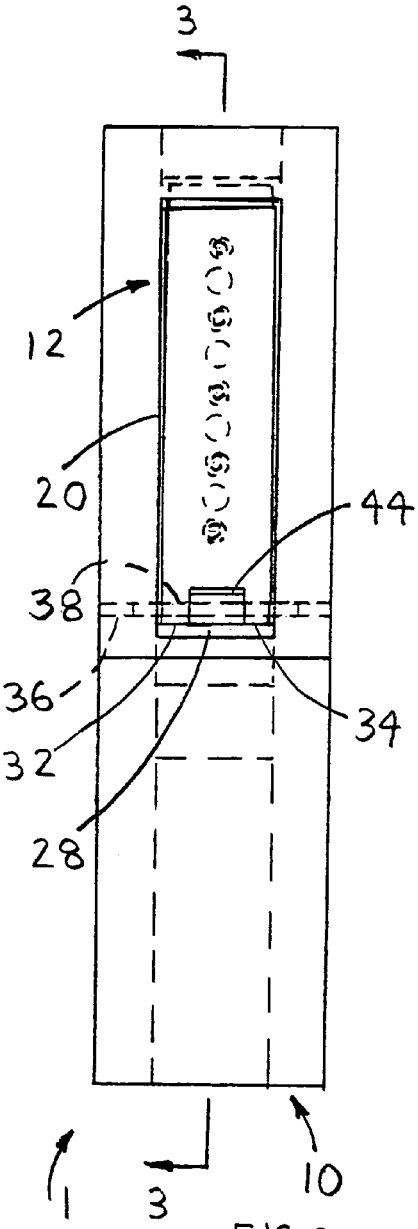
FIG. 2 is a side cross sectional view of a pressure grip in accordance with the present invention.

With reference now to the drawings, and particularly to FIG. 1, there is shown a side view of a pressure grip 1 mounted on a goalie hockey stick 100. With reference to FIGS. 2–3, the pressure grip 1 includes a support boot 10 and a hand grip 12. The support boot 10 includes a paddle portion 14 and a handle portion 16. The handle portion 16 extends from the paddle portion 14. The handle portion 16 and paddle portion 14 are preferably fabricated from a single piece of material. An inside perimeter of the paddle portion 14 is sized to receive an outer perimeter of a paddle 102 of the goalie hockey stick 100. An inside perimeter of the handle portion 16 is sized to receive an outer perimeter of a handle 104 of the goalie hockey stick 100.

The support boot 12 is secured to the handle 104 by forming a fastener hole through the handle portion 16 and inserting a fastener 15 through the fastener hole and securing the fastener 15 to the handle 104. A thumb grip 18 preferably extends outward at an angle from the handle portion 16, but other designs of thumb grips may also be used. It is preferably that the support boot 10 be fabricated from a molded plastic with a rubberized feel. The rubberized feel will provide extra grip for the player's thumb on the thumb grip 18.

A grip slot 20 is formed through the handle portion 16 opposite the thumb grip 18. The grip slot 20 is sized to receive the hand grip 12. The hand grip 12 preferably includes a pivotal handle 22, a projection plate 24 and at least one spring 26. The pivotal handle 22 includes a substantially triangular body. A pivot yoke 28 is formed on one end of the pivotal handle 22 and a retention flange 30 is formed on the other end thereof. The pivot yoke 28 includes a first leg 32 and a second leg 34. A pin hole 36 is formed through the first and second legs and the support boot 10 to receive a pivot pin 38. A flange undercut 40 is formed in a top of the grip slot 20 to retain the retention flange 30. The at least one spring 26 may be molded in the pivotal handle 22 or retained in pockets. The pivotal handle 22 is preferably fabricated from a molded plastic with a rubberized feel. The rubberized feel will provide a grip for the player's fingers.

The projection plate 24 includes a plurality of projections 42. The plurality of projections 42 may be extruded from the projection plate 24 or attached to the projection plate 24 with any suitable method. Each projection 42 includes a sharp end that will pierce the handle 104, when hand pressure is applied to the pivotal handle 22. The at least one spring 26 is preferably strong enough to improve hand strength by squeezing the pivotal handle 22. A pin flange 44 is formed on one end of the projection plate 24. A width of the pin flange 44 is sized to be received by the pivot yoke 28. The pin flange 44 is rolled over to receive the pivot pin 38, but other methods of retaining the pivot pin 38 may also be used. The projection plate 24 is preferably fabricated from steel, but other materials may also be used.

The pressure grip 1 may also be used on non-goalie hockey sticks. The support boot 10 would not require a paddle portion 14, if attached to the non-goalie hockey stick.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A support grip for a hockey stick, comprising:

a support boot including an inner perimeter that is sized to receive an outer perimeter of a handle of the hockey stick, a grip slot being formed through said support boot to the handle; and a hand grip that is sized to be received by said grip slot, movably retaining said hand grip relative to said support boot, said hand grip being biased outward relative to said support boot, at least one spring being used to bias said hand grip outward to provide a strengthening counterforce to squeezing by a hand, extending at least one projection from said hand grip, said at least one projection digging into the handle when hand grip is gripped by a hand.

2. The support grip for a hockey stick of claim 1, further comprising:

said hand grip including a pivotal handle and a projection plate, one end of said pivotal handle and said projection plate being pivotally secured to said support boot, said at least one projection being formed on said projection plate.

3. The support grip for a hockey stick of claim 1, further comprising:

said support boot including a handle portion and a paddle portion, an inner perimeter of said handle portion being sized to receive the handle, an inner perimeter of said paddle portion being sized to receive a paddle of the hockey stick.

4. The support grip for a hockey stick of claim 1, further comprising:

a thumb grip extending from said support boot opposite said hand grip.

5. A support grip for a hockey stick, comprising:

a support boot including an inner perimeter that is sized to receive an outer perimeter of a handle of the hockey stick, a grip slot being formed through said support boot to the handle; and a hand grip that is sized to be received by said grip slot, movably retaining said hand grip relative to said support boot, said hand grip being biased outward relative to said support boot, extending at least one projection from said hand grip, said at least one projection digging into the handle.

6. The support grip for a hockey stick of claim 5, further comprising:

at least one spring being used to bias said hand grip outward to provide a strengthening counterforce to squeezing by a hand.

7. The support grip for a hockey stick of claim 5, further comprising:

said hand grip including a pivotal handle and a projection plate, one end of said pivotal handle and said projection plate being pivotally secured to said support boot, said at least one projection being formed on said projection plate.

8. The support grip for a hockey stick of claim 5, further comprising:

said support boot including a handle portion and a paddle portion, an inner perimeter of said handle portion being sized to receive the handle, an inner perimeter of said paddle portion being sized to receive a paddle of the hockey stick.

9. The support grip for a hockey stick of claim 5, further comprising:

a thumb grip extending from said support boot opposite said hand grip.

10. A support grip for a hockey stick, comprising:

a support boot including an inner perimeter that is sized to receive an outer perimeter of a handle of the hockey stick, a grip slot being formed through said support boot to the handle; and a hand grip that is sized to be received by said grip slot, pivotally retaining one end of said hand grip relative to said support boot, said hand grip being biased outward relative to said support boot, extending at least one projection from said hand grip, said at least one projection digging into the handle.

11. The support grip for a hockey stick of claim 10, further comprising:

at least one spring being used to bias said hand grip outward to provide a strengthening counterforce to squeezing by a hand.

12. The support grip for a hockey stick of claim 10, further comprising:

said hand grip including a pivotal handle and a projection plate, one end of said pivotal handle and said projection plate being pivotally secured to said support boot, said at least one projection being formed on said projection plate.

13. The support grip for a hockey stick of claim 10, further comprising:

said support boot including a handle portion and a paddle portion, an inner perimeter of said handle portion being sized to receive the handle, an inner perimeter of said paddle portion being sized to receive a paddle of the hockey stick.

14. The support grip for a hockey stick of claim 10, further comprising:

a thumb grip extending from said support boot opposite said hand grip.

* * * * *